United States Patent [19]

Mizuguchi et al.

[11] 4,360,815

[45] Nov. 23, 1982

[54] BIFOCAL REFLECTOR ANTENNA AND ITS CONFIGURATION PROCESS

[75] Inventors: Yoshihiko Mizuguchi; Masataka Akagawa, both of Tokyo, Japan

[73] Assignee: Kokusai Denshin Denwa Kabushiki Kaisha, Tokyo, Japan

[21] Appl. No.: 218,236

[22] Filed: Dec. 19, 1980

[30] Foreign Application Priority Data

Jan. 11, 1980 [JP] Japan ..... 55-1268

[51] Int. Cl.[3] ..... H01Q 19/19

[52] U.S. Cl. ..... 343/781 P; 343/836

[58] Field of Search ..... 343/781 P, 781 CA, 836, 343/914, 779

[56] References Cited

U.S. PATENT DOCUMENTS 3,914,768 10/1975 Ohm ..... 343/781 CA

*Primary Examiner*—Eli Lieberman

*Attorney, Agent, or Firm*—Pollock, Vande Sande & Priddy

[57] ABSTRACT

The present invention provides a bifocal reflector antenna with no aberration and a configuration process thereof wherein the two-dimensional Ray Lattice Method is extended to the three-dimensional method. By setting the central section curve of a subreflector or main reflector as an initial condition, the surface curves of the sub- and main reflectors are determined so that a ray from the focus to the antenna aperture can satisfy the reflection law and path length condition. The aberration over the antenna aperture is perfectly eliminated by using the new method.

4 Claims, 5 Drawing Figures

BIFOCAL REFLECTOR ANTENNA AND ITS CONFIGURATION PROCESS

THE FIELD OF THE INVENTION

The present invention relates to a bifocal reflector antenna for a multi-beam satellite antenna and its configuration process.

DESCRIPTION OF THE PRIOR-ART

The prior-art bifocal antennas have been configured by the following procedure.

At first, the surface curves of the main reflector and the subreflector are obtained two-dimentionally by using the conventional Ray Lattice Method. This method assumes that (a) each of those configuration curves are axially symmetric, (b) each of those configuration curves satisfy the reflection law on each of the two reflectors, and (c) the entire path length of any ray from the focus to the antenna aperture via the sub- and main reflectors is constant. Next, rotating those respective configuration curves around the axis, the rotationally symmetrical surface curves are obtained.

SUMMARY OF THE INVENTION

It is a primary object of the invention to provide a bifocal reflector antenna with no aberration and to provide a configuration process thereof.

Another object of the invention is to provide a bifocal reflector antenna having an excellent cross polarization performance by reducing the deformed representation due to the reflector system.

The present invention has resulted from a new concept that the prior-art Ray Lattice Method can apply threedimensionally to the bifocal reflector antennas. The novel features of the invention are to form both the subreflector and the main reflector by setting freely the central section curve of the subreflector or main reflector as an initial curve. As a ray radiated from the feed horn to the antenna aperture via the subreflector and the main reflector satisfies the reflection law and a path length condition, the aberration over the aperture will be removed thoroughly.

DETAILED DESCRIPTION OF THE INVENTION

Figure 1:
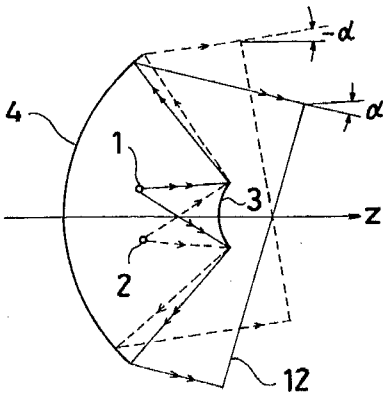
FIG. 1 PRIOR ART
FIG. 1 is a schematic illustration of the prior-art bifocal antenna.

The prior-art bifocal reflector antenna will be described hereinafter. FIG. 1 is a schematic diagram illustrating the principle of the bifocal reflector antenna. As illustrated in the figure, the conventional bifocal reflector antenna is composed by two symmetrical surfaces 3, 4 around the Z axis. The two beams emitted from the phase center 1 (a focus) of one feed horn and the phase center 2 of the other are reflected by the subreflector 3 and by the main reflector 4 in order. As indicated by full lines for the former beam and by broken lines for the latter beam, the rays proceed in two directions of the angles of $\alpha$ and $-\alpha$. The full line numbered 12 in FIG. 1 represents a wave front.

The configuration curves of the main reflector 3 and subreflector 4 can be derived two-dimensionally by the conventional Ray Lattice Method. The assumptions are made that (a) each curve is symmetrical with respect to the Z-axis, (b) the reflection law is satisfied on each reflector surface, and (c) the entire path length of any ray from the focus to the antenna aperture is constant. The rotationally symmetric surface around the Z-axis has been used as the prior-art bifocal antenna reflector (Kumazawa: "Dual Deflector Type Multi-Beam Antenna for Communication Satellite", the Transactions of the Institute of Electronics and Communication Engineers of Japan, B-Vol. 58, No. 8, P377).

It is reported that an antenna obtained by the aforementioned procedure can be used as a satellite multibeam antenna.

Further, the offset bifocal reflector antenna is composed by trimming the curved surface of the rotationally symmetric reflector to avoid aperture blocking. (Kumazawa et al.: "Feasibility Study on a Bifocal Offset Cassegrain Antenna", the National Conference for the Institute of Electronics and Communication Engineers of Japan No. 93, 1978).

However, in the prior-art bifocal reflector antennas using such rotationally symmetric reflector system as described above, the foci are distributed along a circumference. This antenna has following disadvantages.

(1) When the phase center of the feed horn is placed at a point on the circumference, the path length from the feed point to the aperture is constant only within the plane containing the feed point and the Z-axis. On the other hand, an aberration (or a phase error) occurs at all the other points on the aperture. This aberration results in grain reductions and also increases the sidelobe level resulting in isolation degradation.

(2) In an offset bifocal reflector antenna formed by the part of the rotationally symmetric reflector as given above, the actual beam direction will be different from the designed one due to said aberration.

(3) The electric field distribution of the feed horn projected on the antenna aperture is determined uniquely by the location of the foci and the beam direction, and is generally distorted. Thus, the cross polarization and the null of higher-order mode pattern for tracking are degradated.

Figure 2:
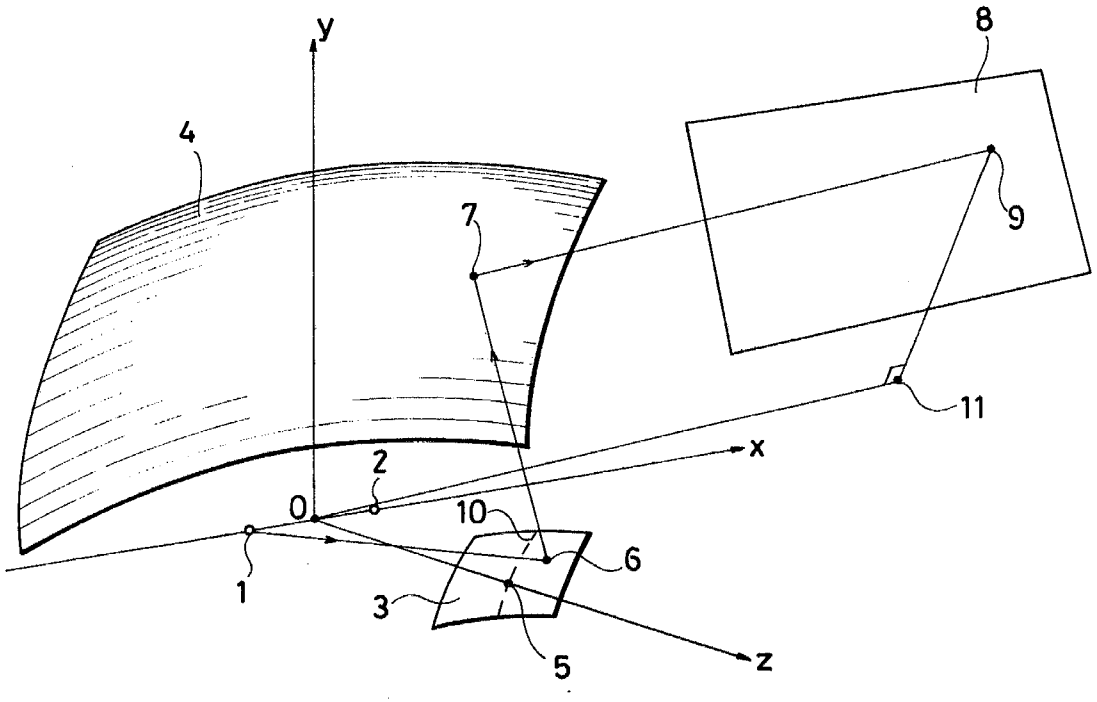
FIG. 2 is a schematic illustration according to the first embodiment of the present invention.

FIG. 2 is the first embodiment of the present invention.

The subreflector 3, the main reflector 4, and the foci 1 and 2 are symmetrical with respect to the y-z plane. A beam radiated from the focus 1 is reflected at reflective point 6 on the subreflector 3 and at reflective point 7 on the main reflector 4, and reaches point 9 on the aperture 8. Although the surface shapes of the reflective surfaces of main reflector 4, subreflector 3 and the aperture 8 are drawn in rectangular, those shapes are not essential but may be either circular or elliptical.

In FIG. 2, there is only one aperture 8 corresponding to the focus 1, but there exists another aperture corresponding to the focus 2. Those two apertures are symmetric with respect to the y-z plane.

The design procedure of the surface curves of the main reflector and subreflector of the present invention will be briefly described hereinafter.

In FIG. 2 the center of the subreflector is only at reflective point 5 on the Z-axis in the prior-art two-dimensional Ray Lattice Method. On the other hand, the center of subreflector 3 of the present invention is moved from the x-z plane to the y-z plane and extended onto the central section curve 10 as shown in the Figure. This central section curve 10 may be selected as any curve so long as the curve 10 satisfies the requirements of path length condition and the reflection law. Let the coordinate of the central section curve 10 be given $Z_s = g(O, Y_s)$ in FIG. 2.

Now, the Ray Lattice Method to design three-dimensional reflector surfaces is described below.

(i) Obtain a surface point (or element) and its gradient of the main reflector 4 from the path length condition and reflection law.

(ii) Obtain the surface point (or element) symmetrical with the one given by the step (i) from the condition that the main reflector surface is symmetrical with respect to the y-z plane.

(iii) Obtain a surface point (or element) and its gradient of the subreflector from the path length condition and reflection law by using the surface point of the main reflector.

(iv) Obtain the surface point (or element) symmetrical with the one given by the step (iii) from the condition that the subreflector surface is symmetrical with respect to the y-z plane.

(v) Obtain the surface point and its gradient of the main reflector by the same procedure as in step (i) by referencing the surface point of the subreflector given by step (iv).

(vi) Obtain the first set of surface points (or surface segment) of the subreflector and main reflector by repeating steps (ii) to (v).

(vii) Obtain the second set of surface points of the subreflector and main reflector being out of the x-z plane by moving the center 5 of the subreflector 3 from the Z-axis and by repeating said steps from (i) to (v).

(viii) Obtain the three dimensional surface curves for the subreflector and the main reflector by repeating the step (vii).

Said steps from (i) to (vi) are essentially the same as the two dimensional Ray Lattice Method applied to the prior-art bifocal reflector antenna.

The design procedures of the surface curves of the main reflector and the subreflector will be described in detail in the following.

In the coordinate system shown in FIG. 2, four vectors, each from the origin O to the focus 1 of the feed horn, to a point on the subreflector, to a point on the main reflector, and to a point on the aperture, are given by the following formulas, respectively, where the symbol → used in all formulas and equations represents vectors.

Focus: $\vec{X_f} = \pm X_f \vec{i_x}$

Subreflector: $\vec{P} = X_s \cdot \vec{i_x} + y_s \cdot \vec{i_y} + Z_s \cdot \vec{i_z}$ where $Z_s = g(x_s, y_s)$ Main reflector: $\vec{Q} = X_m \cdot \vec{i_x} + y_m \cdot \vec{i_y} + Z_m \cdot \vec{i_z}$ where $Z_m = f(X_m, y_m)$ Aperture: $\vec{A} = A\vec{a} = A(\mp \sin\theta \cos\phi\, \vec{i_x} + \sin\theta \sin\phi\, \vec{i_y} + \cos\theta\, \vec{i_z})$ Where the duplicated signs ± on the same level in the above formula are related to each other as upper to upper or lower to lower. The upper signs correspond to the focus 2 and the lower signs to the focus 1. Symbols $\vec{i_x}$, $\vec{i_y}$, and $\vec{i_z}$ represent the unit vector.

For convenience' sake, the following description assumes the case where the phase center of the feed horn is placed at the focus 1.

The unit normal $\vec{n_s}$ on the subreflector is given by the formula:

$$\vec{n_s} = \frac{\frac{\partial \vec{P}}{\partial y_s} \times \frac{\partial \vec{P}}{\partial x_s}}{\left| \frac{\partial \vec{P}}{\partial y_s} \times \frac{\partial \vec{P}}{\partial x_s} \right|} = \frac{\frac{\partial g}{\partial x_s} \vec{i_x} + \frac{\partial g}{\partial y_s} \vec{i_y} - \vec{i_z}}{\sqrt{\left(\frac{\partial g}{\partial x_s}\right)^2 + \left(\frac{\partial g}{\partial y_s}\right)^2 + 1}}$$

The unit vector $\vec{S_1}$ from the subreflector 3 to the main reflector 4 is given by the formula:

$$\vec{S_1} = \frac{\vec{P} - \vec{X_f}}{|\vec{P} - \vec{X_f}|} - 2\left(\frac{\vec{P} - \vec{X_f}}{|\vec{P} - \vec{X_f}|} \cdot \vec{n_s}\right) \vec{n_s}.$$

$$= \lambda_s \vec{i_x} + \mu_s \vec{i_y} + \upsilon_s \vec{i_z}$$

where:

$$\lambda_s = \frac{x_s + x_f}{r} - 2 \cdot \frac{h}{r} \cdot \frac{\partial g}{\partial x_s}$$

$$\mu_s = \frac{y_s}{r} - 2 \cdot \frac{h}{r} \cdot \frac{\partial g}{\partial y_s}$$

$$\upsilon_s = \frac{g}{r} + \frac{2h}{r}$$

$$h = \frac{\frac{\partial g}{\partial x_s}(x_s + x_f) + \frac{\partial g}{\partial y_s} y_s - g}{1 + \left(\frac{\partial g}{\partial x_s}\right)^2 + \left(\frac{\partial g}{\partial y_s}\right)^2}$$

$$r = \sqrt{(x_s + x_f)^2 + y_s^2 + z_s^2}$$

The path length S from the subreflector to the main reflector is given by the following formula as the total path length is a constant value K (=r+s+t), where symbol t represents the path length from the main reflector to the antenna aperture:

$$s = \frac{A - k + r - \vec{P} \cdot \vec{a}}{(\vec{s_1} - \vec{a}) \cdot \vec{a}}$$

$$= \frac{A - k + r - (x_s \sin\theta \cos\phi + y_s \sin\theta \sin\phi + g\cos\theta)}{\lambda_s \sin\theta \cos\phi + \mu_s \sin\theta \sin\phi + \upsilon_s \cos\theta - 1}$$

Accordingly, the vector $\vec{Q}$ from original point 7 on the main reflector is given by $$\vec{Q} = \vec{P} + s\vec{S_1}$$

where each component of vector $\vec{Q}$ is given by $$\left.\begin{aligned} x_m &= x_s + s\lambda_s \\ y_m &= y_s + s\mu_s \\ z_m &= z_s + s\nu_x \end{aligned}\right\} \quad (1)$$

Since the vector $$\left(\frac{\vec{P}-\vec{Q}}{|\vec{P}-\vec{Q}|} - \vec{a}\right)$$

i.e. the normal direction of the main reflector is perpendicular to the vectors $$\frac{\partial \vec{Q}_m}{\partial x_m} \text{ and } \frac{\partial \vec{Q}_m}{\partial y_m}$$

in the tangential directions of the main reflector, that is $$\frac{\partial \vec{Q}_m}{\partial x_m}\cdot\left(\frac{\vec{P}-\vec{Q}}{|\vec{P}-\vec{Q}|} - \vec{a}\right) = 0 \text{ and}$$

$$\frac{\partial \vec{Q}_m}{\partial y_m}\cdot\left(\frac{\vec{P}-\vec{Q}}{|\vec{P}-\vec{Q}|} - \vec{a}\right) = 0$$

The gradient of the main reflector is given by the formulas (2) below:

$$\left.\begin{aligned} \frac{\partial f}{\partial x_m} &= -\frac{S\sin\theta\cos\phi + x_s - x_m}{S\cos\theta + g - f} \\ \frac{\partial f}{\partial y_m} &= -\frac{S\sin\theta\sin\phi + y_s - y_m}{S\cos\theta + g - f} \end{aligned}\right\} \quad (2)$$

Thus, the surface point and its gradient of the main reflector are determined.

The surface point and its gradient of the subreflector can also be obtained in the same manner as mentioned above with the condition that the main reflector surface is symmetric with respect to the y-z plane. Each component of the Vector P from the original point 6 on the subreflector is given by the formulas (3) below:

$$\left.\begin{aligned} x_s &= x_m + s\lambda_m \\ y_s &= y_m + s\mu_m \\ z_s &= z_m + s\nu_m \end{aligned}\right\} \quad (3)$$

The gradient of the subreflector is also given by the formulas (4) below:

$$\left.\begin{aligned} \frac{\partial g}{\partial x_s} &= -\frac{(r+s)x_s - xfs - x_m r}{(r+s)g - rf} \\ \frac{\partial g}{\partial y_s} &= -\frac{(r+s)y_s - ry_m}{(r+s)g - rf} \end{aligned}\right\} \quad (4)$$

Where:

$$\lambda_m = -\sin\theta\cos\phi - 2h\frac{\partial f}{\partial x_m}$$

-continued $$\mu_m = -\sin\theta\sin\phi - 2h\frac{\partial f}{\partial y_m}$$

$$\nu_m = -\cos\theta + 2h$$

$$h = \frac{-\frac{\partial f}{\partial x_m}\sin\theta\cos\phi - \frac{\partial f}{\partial y_m}\sin\theta\sin\phi + \cos\theta}{1 + \left(\frac{\partial f}{\partial x_m}\right)^2 + \left(\frac{\partial f}{\partial y_m}\right)^2}$$

$$s = \frac{(k-t)^2 - y_m^2 - f^2 - (x_m - x_f)^2}{2\{\lambda_m(x_m - x_f) + \mu_m y_m + \nu_m z_m + k - t\}}$$

$$t = A - (x_m\sin\theta\cos\phi + y_m\sin\theta\sin\phi + f\cos\theta)$$

$$r = \sqrt{(x_s - x_f)^2 + y_s^2 + z_s^2}$$

To actually determine the entire reflector system, the surface point and its gradient of the main reflector is obtained from the aforementioned formulas (1) and (2) by choosing one surface point $$\left(x_s = 0, \frac{\partial g}{\partial x_s} = 0\right)$$

of the central section curve 10 on the subreflector.

Next, the surface point and its gradient of the subreflector is obtained from the formulas (3) and (4) substituting $x_m \rightarrow -x_m$ and $$\frac{\partial f}{\partial x_m} \rightarrow -\frac{\partial f}{\partial x_m}$$

from the symmetrical condition of the main reflector with the respect to the y-z plane as previously described step (ii). Then, the surface point and its gradient of the main reflector is obtained from the formulas (1) and (2) replacing $x_s \rightarrow -x_s$ and $$\frac{\partial g}{\partial x_s} \rightarrow -\frac{\partial g}{\partial x_s}.$$

Further, by repeating the procedures described in step (vii) while changing the location of the point on the central section curve 10, the configuration of the entire reflector system is obtained.

The surface curves of the main reflector and subreflector thus designed for a bifocal antenna satisfy the path length condition over the entire antenna aperture. Therefore no aberration is caused in an antenna of the present invention. And further, even an offset type antenna designed by the present invention procedure does not cause any aberration. Accordingly gain reduction and sidelobe increase due to blocking or aberration never occur.

Figure 3:
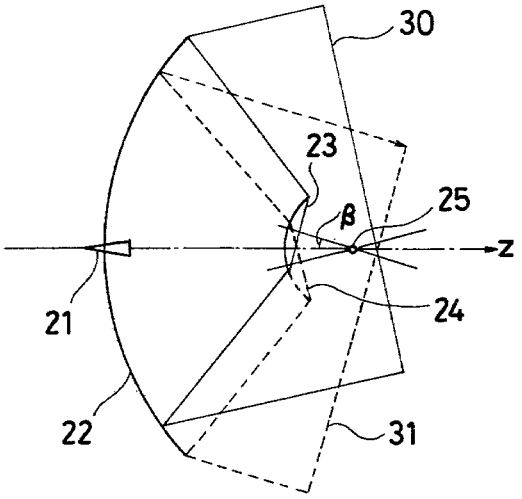
FIG. 3 is a schematic diagram illustrating the principle of a beam scanning antenna with limited movable subreflector.
Figure 4:
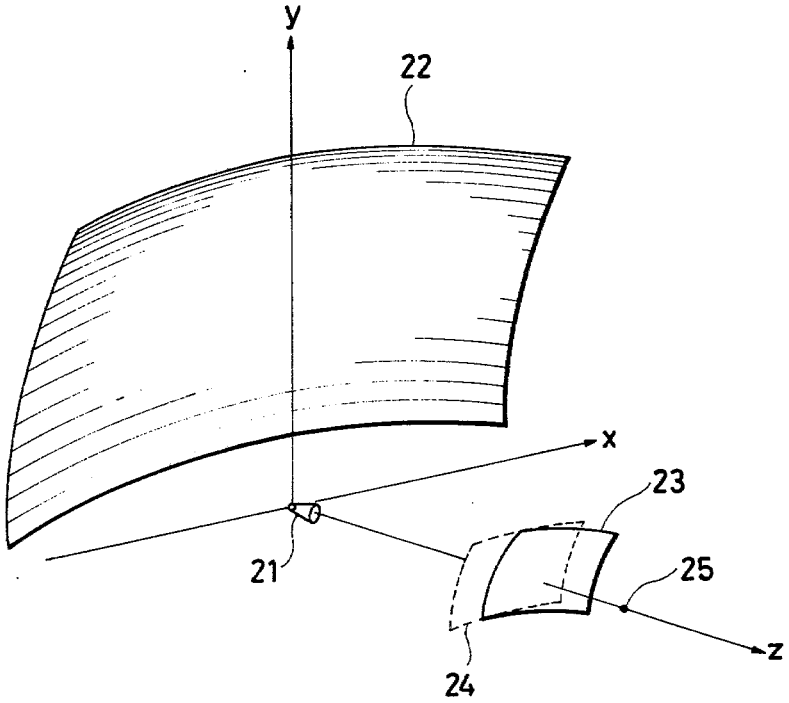
FIG. 4 is a schematic illustration according to the second embodiment of the present invention.

FIG. 3 is a schematic diagram illustrating the principle of the second embodiment of the present invention and FIG. 4 shows the second embodiment of the present invention. Those figures show a beam scanning antenna with movable subreflector.

This antenna has two wavefronts 30 and 31 with no aberration when one feed horn 21 is placed at the central part of the antenna. By rotating the subreflector around the rotational center 25 by the angle of $\pm\beta$, the antenna beam can be steered.

The numeral symbols 23 and 24 in FIGS. 3 and 4 represent the rotated subreflectors around the rotational center 25 by the angle of $\pm\beta$, respectively.

If a coordinate ($x_s$, $y_s$, $z_s$) for a surface point on the subreflector and its gradient $$\left(\frac{\partial z_s}{\partial x_s}, \frac{\partial z_s}{\partial y_x}\right)$$

are given, both the surface point ($x_m$, $y_m$, $z_m$) on the main reflector and its gradient $$\left(\frac{\partial z_m}{\partial x_m}, \frac{\partial z_m}{\partial y_m}\right)$$

can be obtained in the same manner as described in the aforementioned first embodiment.

The detailed description of the design procedure is omitted here in this specification and only the calculated results will be described below.

(a) The surface point of the main reflector $$\begin{pmatrix} x_m \\ y_m \\ z_m \end{pmatrix} = \begin{pmatrix} x_s \\ y_s \\ z_s \end{pmatrix} + s_1 \begin{pmatrix} \lambda_1 \\ \mu_1 \\ \upsilon_1 \end{pmatrix}$$

where $$s_1 = \frac{A - k + r - (x_s \sin\theta \cos\phi + y_s \sin\theta \sin\phi + z_s \cos\theta)}{\lambda_1 \sin\theta \cos\phi + \mu_1 \sin\theta \sin\phi + \upsilon_1 \cos\theta - 1}$$

$$\lambda_1 = \frac{1}{r_1}(x'_s \cos\beta - z'_s \sin\beta) - \frac{2h_1}{r_1}\left(\sin\beta + \frac{\partial z'_s}{\partial x'_s}\cos\beta\right)$$

$$\mu_1 = \frac{y'_s}{r_1} - \frac{2h_1}{r_1}\frac{\partial z'_s}{\partial y'_s}$$

$$\upsilon_1 = \frac{1}{r_1}(x'_s \sin\beta + z'_s \cos\beta + z_0) - \frac{2h_1}{r_1}\left(\frac{\partial z'_s}{\partial x'_s}\sin\beta - \cos\beta\right)$$

$$r_1 = \sqrt{x_s'^2 + y_s'^2 + z_s'^2 + z_0^2 + 2z_0(x'_s \sin\beta + z'_s \cos\beta)}$$

$$h_1 = \frac{\frac{\partial z'_s}{\partial x'_s}x'_s + \frac{\partial z'_s}{\partial y'_s}y'_s - z'_s + z_0\left(\frac{\partial z'_s}{\partial x'_s}\sin\beta - \cos\beta\right)}{1 + \left(\frac{\partial z'_s}{\partial x'_s}\right)^2 + \left(\frac{\partial z'_s}{\partial y'_s}\right)^2}$$

(b) The gradient of the main reflector $$\frac{\partial z_m}{\partial x_m} = -\frac{x_m - x'_s \cos\beta + z'_s \sin\beta + s_1 \sin\theta \cos\phi}{z_m - x'_s \sin\beta - z'_s \cos\beta - z_0 + s_1 \cos\theta}$$

$$\frac{\partial z_m}{\partial y_m} = -\frac{y_m - y'_s + s_1 \sin\theta \sin\phi}{z_m - x'_s \sin\beta - z'_s \cos\beta - z_0 + s_1 \cos\theta}$$

Where the variables with prime constitute the coordinate of the subreflector in new coordinate system. As shown in FIG. 3, the new coordinate system is made by rotating the subreflector around new y-axis pivotally at the rotational center 25 (O, O, $z_o$) as new origin. The new coordinate system has the following relationship to the original one ($x_s$, $y_s$, $z_s$);

$$\begin{pmatrix} x'_s \\ z'_s \end{pmatrix} = \begin{pmatrix} \cos\beta & \sin\beta \\ -\sin\beta & \cos\beta \end{pmatrix} \begin{pmatrix} x_s \\ z_s - z_o \end{pmatrix}$$

$$\frac{\partial z'_s}{\partial x'_s} = \frac{\frac{\partial z_s}{\partial x_s} - \tan\beta}{1 + \frac{\partial z_s}{\partial x_s}\tan\beta}$$

$$\frac{\partial z'_s}{\partial y'_s} = \frac{\partial z_s}{\partial y_s}$$

If the coordinate ($x_m$, $y_m$, $z_m$) of a surface point of the main reflector and its gradient $$\left(\frac{\partial z_m}{\partial x_m}, \frac{\partial z_m}{\partial y_m}\right)$$

are given, both the corresponding coordinate ($x_s$, $y_s$, $z_s$) of the subreflector and its gradient $$\left(\frac{\partial z_s}{\partial x_s}, \frac{\partial z_s}{\partial y_s}\right)$$

can be obtained.

(c) The location of the subreflector $$\begin{pmatrix} x_s \\ y_s \\ z_s \end{pmatrix} \begin{matrix} = \\ = \\ = \end{matrix} \begin{pmatrix} x_m \\ y_m \\ z_m \end{pmatrix} + s_2 \begin{pmatrix} \lambda_2 \\ \mu_2 \\ \upsilon_2 \end{pmatrix}$$

where $$s_2 = \frac{(k - t)^2 - (x_m^2 + y_m^2 + z_m^2)}{2(\lambda_2 x_m + \mu_2 y_m + \upsilon_2 z_m + k - t)}$$

$$t = A - (x_m \sin\theta \cos\phi + y_m \sin\theta \sin\phi\, z_m \cos\theta)$$

$$\lambda_2 = -\sin\theta \cos\phi + 2h_2\frac{\partial z_m}{\partial x_m}$$

$$\mu_2 = -\sin\theta \sin\phi + 2h_2\frac{\partial z_m}{\partial y_m}$$

$$\upsilon_2 = -\cos\theta - 2h_2$$

$$h_2 = \frac{\frac{\partial z_m}{\partial x_m}\sin\theta \cos\phi + \frac{\partial z_m}{\partial y_m}\sin\theta \sin\phi - \cos\theta}{1 + \left(\frac{\partial z_m}{\partial x_m}\right)^2 + \left(\frac{\partial z_m}{\partial y_m}\right)^2}$$

(d) The gradient of the subreflector $$\frac{\partial z'_s}{\partial x'_s} = -\frac{r_2\{x'_s - x_m \cos\beta + (z_0 - z_m)\sin\beta\} + s_1(x'_s + z_0 \sin\beta)}{r_2\{z'_s + x_m \sin\beta + (z_0 - z_m)\cos\beta\} + s_2(z'_s + z_0 \cos\beta)}$$

$$\frac{\partial z'_s}{\partial y'_s} = \frac{r_2(y'_s - y_m) + s_2 y'_s}{r_2\{z'_s + x_m \sin\beta + (z_0 + z_m)\cos\beta\} + s_2(z'_s + z_0 \cos\beta)}$$

where

-continued $$r_2 = \sqrt{x_s^2 + y_s^2 + z_s^2}$$

The description given so far is for a design procedure of the surface curves of the main reflector and the subreflector wherein the central section curve of the subreflector is chosen particularly as the initial curve.

In design of the surface curves, it is, however, not mandatory to choose particularly the central section curve of the subreflector as the initial one, but any curve may be chosen as the initial curve.

But this curve should be on the surface of either the subreflector or the main reflector and the values of x, z, $$\frac{\partial z}{\partial x}, \text{ and } \frac{\partial z}{\partial y}$$

on the curve should be uniquely determined when the value of y is given. In the first embodiment, for example, the design procedure of the surface curves of the main and sub-reflector will be outlined below when a central section curve on the main reflector is given.

When a relation among $y_{mO}$, $z_{mO}$, and $$\frac{\partial z_{m0}}{\partial y_{m0}} \text{ at } x_{mb} = \frac{\partial z_{m0}}{\partial x_{m0}} = 0$$

is given as the initial curve, the coordinate ($x_{s1}$, $y_{s1}$, $s_{s1}$) of the first surface point on the subreflector corresponding to the initial curve and the gradient $$\frac{\partial z_{s1}}{\partial x_{s1}}, \frac{\partial z_{s1}}{\partial y_{s1}}$$

are obtained by using the formulas (3) and (4).

Then, letting $x_{s1} \rightarrow -x_{s1}$, and $$\frac{\partial z_{s1}}{\partial x_{s1}} \longrightarrow -\frac{\partial z_{s1}}{\partial x_{s1}},$$

and substituting $-x_{s1}$, $y_{s1}$, $z_{s1}$, $$-\frac{\partial z_{s1}}{\partial x_{s1}}, \frac{\partial x_{s1}}{\partial y_{s1}}$$

in the formulas (1) (2), the coordinate ($x_{m1}$, $y_{m1}$, $z_{m1}$) of the surface point of the main reflector and the gradients of $$\frac{\partial z_{m1}}{\partial x_{m1}} \text{ and of } \frac{\partial z_{m1}}{\partial y_{m1}}$$

are obtained.

Further, letting $x_{m1} \rightarrow -x_{m1}$ and $$\frac{\partial z_{m1}}{\partial x_{m1}} \longrightarrow -\frac{\partial z_{m1}}{\partial x_{m1}},$$

and substituting $-x_{m1}$, $y_{m1}$, $z_{m1}$, $$-\frac{\partial z_{m1}}{\partial x_{m1}}, \text{ and } \frac{\partial z_{m1}}{\partial y_{m1}}$$

in the formulas (3) and (4), the coordinate ($x_{s1}$, $y_{s2}$, $z_{s2}$) of the corresponding surface point of the subreflector and the gradient $$\frac{\partial z_{s2}}{\partial x_{s2}} \text{ and of } \frac{\partial z_{s2}}{\partial y_{s2}}$$

are obtained.

The surface curves of both the main reflector and the subreflector are determined by repeating the above procedure letting the central section curve of the main reflector be the initial value in the same manner as the central section curve of the subreflector.

Since this method can in principle provide the discrete surface points and gradients of the main reflector and subreflector, the information of the surface curves between the adjacent discrete curves can be obtained by the established techniques including polynominal interpolation.

Now, a method of improving the cross polarization characteristics and the higher mode characteristics for tracking will be described in the following.

The asymmetric antenna may generally cause cross polarization degradation by the distortion of the electric field on the antenna aperture even in the case of no aberration. The reflector system of the prior-art bifocal antenna is of rotationally symmetric structure, but the foci are not placed at the rotational center. Therefore, the prior-art bifocal antenna is an asymmetric structure in principle, and furthermore there is no degree of freedom in design for improving the cross polarization degradation due to distortion of electric field on the aperture.

On the contrary, the antenna of the present invention has the degree of freedom in configuration of the central section curve 10 $z_s = g(0, y_s)$. Therefore, in this antenna any central section curve to minimize a distortion of the electric field on the antenna aperture may be selected.

Figure 5:
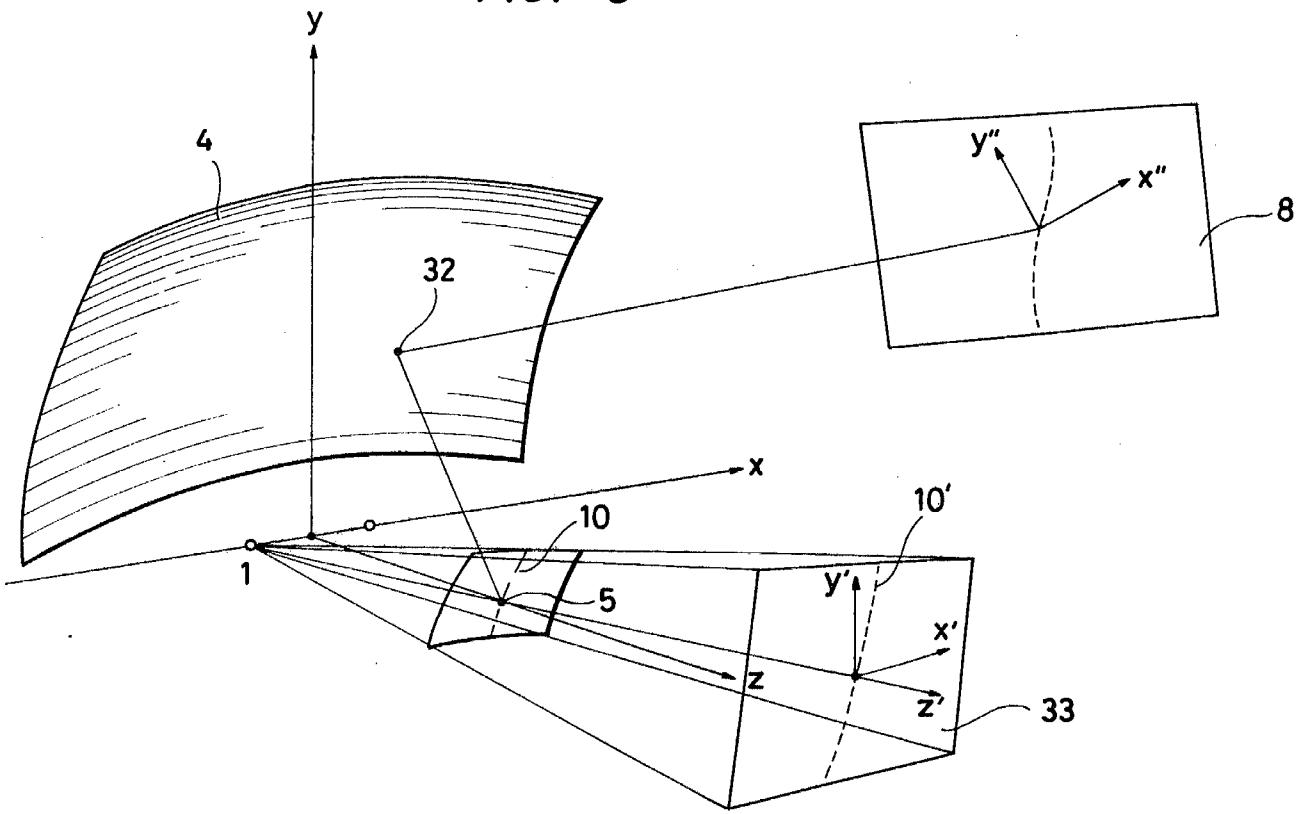
FIG. 5 is a schematic illustration of an antenna including the central section curve.

The cross polarization characteristics and other undesirable phenomenas can be improved by choosing the central section curve of the subreflector. As shown in FIG. 5, this condition is given that the projected representation of the central section curve of the subreflector on the perpendicular screen has a shape similar to the projected representation on the antenna aperture.

In FIG. 5, the numeral symbol 33 represents the screen distant by $R_O$ from the focus 1, the numeral symbol 4 is a main reflector, and the numeral symbol 8 is an antenna apeture. The representation 10' of the central section curve 10 on the perpendicular screen 33 has the following coordinates in the x and y directions in the coordinate system (x', y', z').

$$\left.\begin{aligned} x' &= R_0 \cdot \frac{g - z_{s0}}{x_f^2 + g z_{s0}} \cdot x_f \\ y' &= R_0 \cdot \frac{\sqrt{x_f^2 + z_{s0}^2}}{x_f^2 + g z_{s0}} \cdot y_s \end{aligned}\right\} \quad (5)$$

, where $z_{sO}$ is the z-directional component of the coordinate of reflective point 5 at the intersection of the Z-axis and the central section curve on the subreflector surface.

The representation of the beam being reflected on the central section curve on the antenna aperture has the following coordinate components in the x'' and y'' directions in the coordinate system (x'',y'', z'')

$$\left.\begin{aligned} x'' &= (x_m - x_{m0})(\cos\theta\cos\phi\cos\eta - \sin\phi\sin\eta) + \\ &\quad (y_m - y_{m0})(\cos\theta\sin\phi\cos\eta + \cos\sin\eta) - \\ &\quad (f - F_0)\sin\theta\cos\eta \\ y'' &= (x_m - x_{m0})(-\cos\theta\cos\phi\sin\eta - \sin\phi\cos\phi) + \\ &\quad (y_m - y_{m0})(-\cos\theta\sin\phi\sin\eta + \cos\phi\cos\eta) + \\ &\quad (f - f_0)\sin\theta\sin\eta \end{aligned}\right\} \quad (6)$$

, where $\eta$ is the angle of the vector $\vec{a}$ measured from the unit vector $\vec{i\theta}$ in the direction of the unit vector $\vec{i\phi}$ in the plane containing the unit vectors $\vec{i\theta}$ and $\vec{i\phi}$ of the spherical coordinate system consisting of the orthogonal unit vectors $i\gamma$, $\vec{i\theta}$ and $\vec{i\phi}$. The coordinate ($x_{mO}$, $y_{mO}$, $z_{mO}$) is the reflector point 32 on the main reflector corresponding to the reflective point 5 (0, 0, $z_{sO}$) *on the subreflector.*

The $R_o$ of the formula (5) and the $\eta$ of the formula (6) can be obtained by assuming that the representations $\delta x'$ and $\delta y'$ of the neighborhood of reflective point 5 (0, 0, $z_{sO}$) on the subreflector surface are equal to the representations $\delta x''$ and $\delta y''$ of the neighborhood of reflective point ($x_{mO}$, $y_{mO}$, $z_{mO}$) on the main reflector. The parameters $R_o$ and $\eta$ are given below.

$$\left.\begin{aligned} R_0 &= \frac{x_f^2 + g_0(g_0 + \delta g_1)}{x_f \delta g_1}(U\cos\eta + V\sin\eta) \\ \tan\eta &= \frac{Vx_f\delta g - U(y_{s0} + \delta y_s)\sqrt{x_f^2 + g_0^2}}{\overline{U}x_f\delta g + V(y_{s0} + \delta y_s)\sqrt{x_f^2 + g_0^2}} \\ &\text{where} \\ U &= (x_{m1} - x_{m0})\cos\theta\cos\phi + (y_{m1} - y_{m0})\cos\theta\sin\phi + \\ &\quad (f_1 - f_0)\sin\theta \\ V &= -(x_{m1} - x_{m0})\sin\phi + (y_{m1} - y_{m0})\cos\phi \end{aligned}\right\} \quad (7)$$

The central section curve $z_s = g(O, y_s)$ may be determined from said formulas (5), (6) and (7) by changing the value of $y_s$ so as to be $x' \approx x''$ and $y'' \approx y''$.

In practice, the central section curve can be obtained by the following two methods.

(1) Minimize the mean square error of the two representations. In other words, the central section curve is determined by means of the variational method by minimizing the following functional:

$$I = \int_{y_{smin}}^{y_{smax}} [(x' - x'')^2 + (y' - y'')^2] \sqrt{1 + \left(\frac{\partial g}{\partial y_s}\right)^2}\, dy_s$$

(2) With the aid of a digital computer, changing the values of $y_s'$ and $z_s$ respectively from the initial values (0, 0, $z_{sO}$) *and* ($x_{mO}$, $y_{mO}$, $z_{mO}$) in steps at small amount of variation, calculate values of x', x'', y'', and y'' at every step. Selecting the value between the x' and the x'', and that between the y' and the y'', the values of $y_s$ and $z_s$ are determined as the central section curve.

While in the aforementioned first embodiment the bifocal antenna having two foci was described, a high quality multi-beam antenna or shaped beam antenna can be composed by placing a plurality of feed horns in the neighborhood of the foci. The multi-beam antenna by this technique can reduce the aberration extremely in comparison with the prior-art multi-beam antenna or shaped beam antenna.

As described hereinbefore, the effect of the bifocal reflector antenna according to the present invention is that the aberration can be removed completely. Since the antenna of the present invention may be formed as offset type, there is a great advantage for the gain and the sidelobe level. The further effect of the antenna of the invention is to improve both the cross polarization and higher mode characteristics much higher than the prior-art antenna, as the distortion of the projected representation of the feed horn on the antenna aperture.

What is claimed is:

1. A bifocal reflector antenna comprising a main reflector having two foci which are spaced from one another on opposite sides of and displaced from the axis of the antenna, a subreflector having at most two foci corresponding to said two foci of said main reflector, and at least one feed horn placed at or near the focus or foci for said subreflector, characterized in that said subreflector and said main reflector are respectively constructed in plane symmetry, and are also so constructed that a beam radiated from said feed horn reaches the antenna aperture via said subreflector and said main reflector while satisfying the conditions that (a) at every reflective point on sid subreflector and main reflector said beam meets the law of reflection of a light beam and (b) at every reflective point on said subreflector and main reflector the total length of the beam path from said feed horn to the antenna aperture has the same exactly constant value.

2. A configuration process of a bifocal reflector antenna comprising a subreflector having at least one symmetry plane, a main reflector having at least one symmetry plane, placed opposite to said subreflector and at least one feed horn placed at the foci for said subreflector including the steps of:

(a) setting out the position and gradient of a reference surface point $A_O$ on the intersection line of reflector A, which may be either one of said sub-reflector and said main reflector, and its symmetry plane to obtain both the position and gradient of a reflecting surface point $B_O$ on the other reflector B corresponding to the surface point $A_O$ from the conditions that a light beam radiated from the feed horn meets the law of reflection at the surface point $A_O$ and the length of the beam path from the feed horn to the antenna aperture via the sub-reflector and the main reflector is constant;

(b) obtaining both the position and gradient of a surface point $B_1$ being in plane symmetry with the surface point $B_O$ relative to the symmetry plane of reflector B from the condition that said reflector B is plane symmetric;

(c) obtaining both the position and gradient of a surface point $A_1$ on said reflector A corresponding to the surface point $B_1$ from the conditions that the light beam meets the law of reflection at the surface point $B_1$ and said requirement of a constant length of the beam path passing through the surface point $B_1$;

(d) obtaining both the position and gradient of a surface point $A_2$ being in plane symmetry with the surface point $A_1$ relative to the symmetry of reflector A from the condition that said reflector A is plane symmetric;

(e) obtaining both the position of a surface point $B_2$ on said reflector B corresponding to the surface point $A_2$ and the gradient thereof from the conditions that the law of reflection is satisfied at the surface point $A_2$ and the length of the beam path passing through the surface point $A_2$ is constant;

(f) obtaining first sets of surface points, one for the subreflector and the other for the main reflector, by repeating said steps (b) to (e);

(g) obtaining a new reference surface point $A_O'$ by moving on the symmetry plane of the reflector A the reference surface point $A_O$;

(h) obtaining second sets of surface points, one for the sub-reflector and the other for the main reflector, with respect to the newly obtained reference surface point $A_o'$ by repeating said steps (a) to (f) based on the newly obtained reference surface point $A_O'$;

and (i) obtaining further sets of surface points, one for the sub-reflector and the other for the main reflector successively by repeating said steps (g) and (h) based on the central section curve comprising a collection of said reference surface points ($A_O$, $A_O'$ . . .); wherein both a sub-reflector and a main reflector will be formed by collecting the surface points obtained through each step.

3. A configuration process of a bifocal reflector antenna as claimed in claim 2, wherein the bifocal reflector antenna represents a beam scanning antenna with limited movable sub-reflector.

4. A configuration process of a bifocal reflector antenna as claimed in claim 2, wherein a central section curve is determined so that the form of said central section curve projected on a plane perpendicular to the line connecting said feed horn and said reference surface point $A_O$ is similar to the representation of said central section curve projected on said antenna aperture.

* * * * *